United States Patent [19]

Herold et al.

[11] 4,187,121

[45] Feb. 5, 1980

[54] CLEAR-RINSE AGENT FOR MECHANICAL DISHWASHERS

[75] Inventors: Claus-Peter Herold, Mettmann; Dieter Grodau, Hilden; Theodor Altenschopfer, Dusseldorf, all of Fed. Rep. of Germany

[73] Assignee: Henkel Kommanditgesellschaft auf Atkien, Dusseldorf, Fed. Rep. of Germany

[21] Appl. No.: 906,751

[22] Filed: May 17, 1978

[30] Foreign Application Priority Data

May 28, 1977 [DE] Fed. Rep. of Germany ..... 2724350

[51] Int. Cl.[2] ..... B08B 7/04

[52] U.S. Cl. ..... 134/26; 252/170; 252/DIG. 1; 252/DIG. 6; 536/4

[58] Field of Search ..... 134/25 A, 26, 29; 536/4; 252/170, 173, 142, DIG. 1, DIG. 6, DIG. 11, DIG. 14

[56] References Cited

U.S. PATENT DOCUMENTS

| | | | |
|---|---|---|---|
| 2,374,236 | 4/1945 | Salzberg et al. | 536/4 |
| 2,407,002 | 9/1946 | Griffin | 536/4 |
| 3,324,108 | 6/1967 | Moller et al. | 536/4 X |
| 3,635,827 | 1/1972 | Jakobi | 252/DIG. 1 |
| 3,969,134 | 7/1976 | Batka et al. | 252/DIG. 1 |

*Primary Examiner*—Marc L. Caroff

*Attorney, Agent, or Firm*—Hammond & Littell

[57] ABSTRACT

A clear-rinse agent concentrate for mechanical dishwashers containing, as sheeting component, from 10% to 80% by weight of a reaction product obtained by reacting under acid catalysis conditions (1) an aldose selected from the group consisting of a reducing monosaccharide having 5 to 6 carbon atoms and an oligosaccharide thereof having from 2 to 4 monosaccharide units, with (2) a polyglycol ether having an average molecular weight of from 190 to 450, in a molar ratio of from 1:0.4 to 1:1.5; as well as the method of clear-rinsing employing said agent.

19 Claims, No Drawings

CLEAR-RINSE AGENT FOR MECHANICAL DISHWASHERS

BACKGROUND OF THE INVENTION

In mechanical dishwashing generally two cleaning cycles, usually separated by intermediate rinsing cycles with pure water are used. In the two cleaning cycles, different products are utilized. In the first or true cleaning cycle, alkaline-reacting agents are employed for the loosening and emulsifying of the food residues. In the after-rinsing or clear-rinsing bath, on the other hand, special clear-rinsing agents are employed. The latter should possess a good wetting power and be able to reduce the surface tension of the after rinsing water to such a degree that it drains in a film-like manner from the dishes and leaves no visible deposits, such as lime spots or other impurities, and completely clear dry dishes are obtained. This is called "sheeting" and the clear-rinsing agents concentrates are often stated to have a "sheeting" component.

Because of the violent agitation of the liquor in the dishwasher, these clear-rinsing agent have to be as low-foaming as possible. The customary anionic wetting agents, however, such as higher-molecular weight alkyl sulfates or alkyl sulfonates or aralkyl sulfonates are not generally usuable because they foam too much. In practice, therefore, mostly nonionic tensides based on ethylene-oxide adducts to fatty alcohols, alkylphenols, or polypropylene glycols of higher molecular weights are employed. These products, however, were also found in actual practice to be not sufficiently low-foaming in the concentration range, required for a sufficient wetting effect.

These adducts have been found to cause disturbances due to excessive foam formation particularly in commercial dishwashing machines which have a very high rate of water circulation and a very high return rate of the clear-rinsing liquor into the main rinsing cycle. The same difficulties may also arise in home dishwashing machines. Even with the use of relatively low-foaming ethylene-oxide adducts, it is therefore necessary to add anti-foaming agents to the clear-rinsing agents. The substances used as foam suppressors or anti-foaming agents may be nonionic alkoxylation products which are relatively insoluble in water at the rinsing temperatures employed, that is, adducts of ethylene oxide onto higher alcohols or alkyl phenols having only a low degree of ethoxylation, or similar adducts of ethylene oxide and propylene oxide. However, at the temperatures employed, these products have no wetting action and are therefore a ballast to the clear-rinse agent. Moreover, they are in most cases not sufficiently biologically degradable.

The components of the clear-rinse agent should not only be characterized by good wetting and low foaming but the wetting agents used in them should also be biologically readily degradable and, as for as possible, non-toxic to the living organisms in the water.

Numerous clear-rinse agents which fulfil one or more of the four main requirements, namely efficient wetting, low foaming and/or biological degradability and/or low toxicity are known both in practice and in the literature but there is still a need for clear-rinse agents which will satisfactorily fulfill all four of these requirements. Furthermore, time has shown that a raw material once used is not always available in unlimited quantities so that the expert must constantly find alternatives that are at least equivalent.

In German Published Application DOS No. 2,110,994, clear-rinse agents for automatic dish washing have been disclosed which contain, as their sheeting component, adducts of propylene oxide and non-reducing sugars or sugar derivatives and in Great Britain Pat. No. 1,167,663, corresponding to DOS No. 1,628,642, clear-rinse agents have been disclosed which contain water-soluble starch degradation products and/or sugars as their discharge components. All of these agents are distinguished by sufficiently low foam formation and physiological acceptability and they produce a satisfactory clear drying effect.

OBJECTS OF THE INVENTION

It is therefore an object of the present invention to provide a low foaming clear-rinse agent which contains only sheeting components and reduces or substantially obviates the need for foam-suppressing surface-active agents and other foam-suppressing ballast material, and which has good biological degradability and is, if possible, non-toxic to the organisms living in water.

Another object of the present invention is the development of a clear-rinse agent concentrate for mechanical dishwashers containing, as sheeting component, from 10% to 80% by weight of a reaction product obtained by reacting under acid catalysis conditions (1) an aldose selected from the group consisting of a reducing monosaccharide having 5 to 6 carbon atoms and an oligosaccharide thereof having from 2 to 4 monosaccharide units, with (2) a polyglycol ether having an average molecular weight of from 190 to 450, in a molar ratio of from 1:0.4 to 1:1.5.

A further object of the present invention is the development, in the method of washing dishes in a mechanical dishwasher comprising the steps of subjecting the soiled dishes to the forceful spraying of a cleansing liquor containing a dishwashing detergent, rinsing said dishes with a forceful spray of clear water, subjecting the cleaned and rinsed dishes to the forceful spraying of a clear rinse liquor containing an effective amount of a sheeting component, and drying said cleaned dishes, the improvement consisting essentially of employing as said sheeting component, from 0.05 to 2.6 gm per liter of said clear rinse liquor of a reaction product obtained by reacting under acid catalysis conditions (1) and aldose selected from the group consisting of a reducing monosaccharide having 5 to 6 carbon atoms and an oligosaccharide thereof having from 2 to 4 monosaccharide units, with (2) a polyglycol ether having an average molecular weight of from 190 to 450, in a molar ratio of from 1:0.4 to 1:1.5.

These and other objects of the invention will become more apparent as the description thereof proceeds.

DESCRIPTION OF THE INVENTION

It has now been found that the known results obtained in mechanical or automatic dish washing by using clear-rinse agents containing sheeting components based on sugar derivatives can be surprisingly improved by using clear-rinse agents which contain, as their sheeting component reaction products obtained by the reaction under acid catalysis conditions of reducing monosaccharides having 5 to 6 carbon atoms in the molecule or oligosaccharides of up to 4 such monosaccharide units, with polyglycol ethers having a molecular weight of from 190 to 450, preferably from 300 to 400, in a molar ratio of from 1:0.4 to 1:1.5, preferably from 1:0.75 in the case of monosaccharides or 1:1.4 in the case of oligosaccharides.

More particularly the present invention relates to a clear-rinse agents concentrates for mechanical dishwashers containing, as sheeting component, from 10% to 80% by weight of a reaction product obtained by reacting under acid catalysis conditions (1) an aldose selected from the group consisting of a reducing monosaccharide having 5 to 6 carbon atoms and an oligosaccharide thereof having from 2 to 4 monosaccharide units, with (2) a polyglycol ether having an average molecular weight of from 190 to 450, in a molar ratio of from 1:0.4 to 1:1.5; as well as the improvement in the method of washing dishes in a mechanical dishwasher comprising the steps of subjecting the soiled dishes to the forceful spraying of a cleansing liquor containing a dishwashing detergent, rinsing said dishes with a forceful spray of clear water, subjecting the cleaned and rinsed dishes to the forceful spraying of a clear rinse liquor containing an effective amount of a sheeting component, and drying said cleaned dishes, the improvement consisting essentially of employing, as said sheeting component from 0.05 to 1.6 gm per liter of said clear rinse liquor of a reaction product obtained by reacting under acid catalysis conditions (1) an aldose selected from the group consisting of a reducing monosaccharide having 5 to 6 carbon atoms and an oligosaccharide thereof having from 2 to 4 monosaccharide units, with (2) a polyglycol ether having an average molecular weight of from 190 to 450 in a molar ratio of from 1:0.4 to 1:1.5.

The clear-rinse agents according to the invention have the desired advantageous properties to a high degree. They are water-soluble and virtually non-foaming and have a pronounced wetting action on the dishes.

The sugar derivatives claimed according to the invention as sheeting components can be prepared by a single stage process consisting of an acid catalyzed reaction of reducing monosaccharides (aldoses) with polyglycol ethers analogous to the process described in U.S. Pat. No. 2,407,002. They form clear solutions in water and may therefore be used in clear-rinse agents concentrates without the addition of solvents other than water.

The aldoses used may be monosaccharides having 5 to 6 carbon atoms such as glucose, mannose, galactose, arabinose, or xylose or oligosaccharides of said monosaccharides having 2 to 4 of said monosaccharides units such as maltose, lactose, cellobiose or glucose syrup (a mixture of glucose, maltose, and malto-oligosaccharides obtained from the hydrolysis of starch). Ketoses (non-reducing monosaccharides) such as fructose are less suitable for the reaction because they are much more unstable to acids than aldoses and undergo too much decomposition under the reaction conditions.

The polyglycol ethers used may be polyoxyethylene glycols with molecular weights of from 190 to 450, monopropoxylated derivatives of polyoxyethylene glycols with molecular weights up to 300 and ethoxylated and partially still monopropoxylated alkane diols having from 2 to 6 carbon atoms, alkoxyalkane diols having from 4 to 6 carbon atoms and alkane triols having 3 to 6 carbon atoms such as butane-1,3-diol, butane-1,4-diol, dipropylene glycol or glycerol, all having ethoxylation units and perhaps one propoxylation unit, up to a total molecular weight of 450.

The end of the reaction is reached when the residual quantity of free aldose amounts to less than 4%. This can be determined by means of Fehling's Reagent.

The products obtained only poorly foam, are biologically readily degradable, have an extremely low acute oral toxicity and, above all, are not toxic to the organisms in water.

The products according to the present invention are used in the form of their concentrated aqueous solutions or in the form of concentrated aqueous alcoholic solutions if the other usual additives are not water soluble, to serve as the sheeting component in clear-rinse agents concentrates used in dish washing machines operating on a program comprising a preliminary washing operation, for example using alkaline cleaning agents, and one or more intermediate rinsing operations, preferably in domestic dish washers. Excellent clear drying effects are obtained even when using the claimed products on their own without other clear-rinsing agent components.

In order to obtain equally good results on all different types of dishes to be washed, it may be advantageous to use mixtures of clear-rinsing agents concentrates in which up to 50% by weight, preferably from 10% to 40% by weight of the sugar derivatives of the invention have been replaced by degradable nonionic surface-active agents. The latter are preferably low foaming nonionic surface active agents such as (a) adducts of ethylene oxide onto fatty alcohols having from 8 to 20 carbon atoms or onto alkylphenols having from 8 to 22 carbon atoms in the alkyl or onto higher molecular weight carboxylic acids having more than 12 carbon atoms, for example, tall oil resinic acid, or (b) products of addition of propylene oxide to the above fatty alcohol/ethylene oxide adducts or alkyl phenol/ethylene oxide adducts, or (c) sugar esters of fatty acids containing from 8 to 20 carbon atoms with sugars, and the like.

The clear-rinse agents concentrates are added as aqueous or aqueous/alcoholic concentrates to the clear-rinsing water, preferably by means of automatic metering devices of the type normally used for such purposes or by hand. They contain from 10% to 80% by weight, preferably from 15% to 60% by weight of the sugar derivatives according to the present invention and, optionally, also from 1% to 40% by weight, preferably from 1.5% to 30% by weight of a low foaming, preferably nonionic surface-active agent. The alcoholic solvent component, if used, is preferably a water-miscible alcohol such as ethanol, propanol, or isopropanol, ethylene glycol, propylene glycol, ethoxyethanol or the like. The alcoholic solvents may be added in a quantity of up to 30% by weight, preferably from 1% to 20% by weight, based on the whole concentrate.

The clear-rinse concentrate is added to the rinsing water in an amount of approximately 0.1 to 2.0 gm per liter, preferably from 0.2 to 1.0 gm per liter, depending to some extent on the nature of the surfaces which are to be cleaned. Plastics surfaces generally require a somewhat higher concentration of clear-rinse agents. The hardness of the water, on the other hand, has virtually no influence on the quantity of concentrate required. The clear-rinse liquor should contain from 0.05 to 2.6 gm per liter of the sugar derivatives according to the present invention.

The clear-rinse agents concentrates may, of course, also contain other substances conventionally used in such agents. For example, hydroxyalkane carboxylic acids having from 2 to 6 carbon atoms may be added to the concentrates or to the clear-rinsing water in order to avoid lime deposits or films on the rinsed dishes. Acids which are physiologically harmless and form complexes with the constituents which harden water are preferably used, for example tartaric acid, lactic acid, glycolic acid or, in particular, citric acid. The proportion of acid in the clear-rinse concentrates is preferably approximately from 5% to 40% by weight, preferably from 10% to 35% by weight. Clear-rinse agents concentrates according to the invention which are acid in reaction are also particularly suitable for use in industrial dish washing machines on account of their excellent sheeting effect but excessive lowering of the pH of the clear-rinse water should be avoided as far as possible on account of the risk of corrosion.

Coloring and scenting substances may also be added to the clear-rinse agents concentrates and, if desired, small quantities, usually about 0.05% to 1.0% by weight of preservatives such as formaldehyde and/or sodium benzoate.

The following examples are illustrative of the practice of the invention without being limitative in any manner.

EXAMPLES

A. Preparation of the Sugar Derivatives

Reaction of Monosaccharides 0.75 mol (based on the average molecular weight) of a polyglycol and concentrated sulfuric acid (1% by weight, based on the quantity of monosaccharide used) were introduced into a flask and heated to 100° C. in an oil bath with stirring. 1 mol of a monosaccharide was then added. Any water of crystallization in the monosaccharide and water produced in the reaction was distilled off within 4 hours by application of a vacuum. The vaccum was adjusted to prevent foaming over. The end of the reaction was found by determing the residual content of reducing sugar. The syrup reaction product was either dissolved in water, neutralized with a basic ion exchange resin, clarified with active charcoal and concentrated by evaporation under vacuum or it was neutralized while still hot by the addition of concentrated sodium carbonate or sodium hydroxide solution and bleached with 35% hydrogen peroxide solution at 80° C.

A product having an exceptionally low hydrogen peroxide content can be obtained by adding a suitable quantity of acetic acid anhydride after bleaching. The remaining $H_2O_2$ is converted into peracetic acid which rapidly decomposes under these conditions.

Reaction of Oligosaccharides 1.4 mol of a polyglycol and concentrated sulfuric acid (1% by weight based on the quantity of oligosaccharide put into the process) were introduced into a flask and heated to 100° C. in an oil bath with stirring. A concentrated aqueous solution of an oligosaccharide was then added. The quantity of oligosaccharide was calculated to correspond to 1 mol of free reducing sugar. Water was then distilled off under vaccum. If there is any difficulty in dissolving the oligosaccharide in the polyglycol, the following procedure may be adopted: 1 mol of an aqueous oligosaccharide solution (calculated as reducing sugar) is introduced into a flask and heated to 110° C. in an oil bath. A mixture of polyglycol (1.4 mol) and concentrated sulfuric acid (1% by weight, based on the oligosaccharide) is then added with stirring and at the same time water is distilled off. The polyglycol is added at such a rate that only a slight turbidity occurs in the flask. The reaction, which takes about 7 to 8 hours, is assisted by the addition of a small quantity of the end product.

The reaction is completed when the reducing sugar is found to have virtually disappeared. The reaction product is worked up as indicated above.

The sugar derivatives prepared by this process, which were used as sheeting components according to the invention, are summarized in Table I below. They are identified by their hydroxyl numbers and the results of the investigations into their biological degradability, determined by the GF-Test according to W. K. Fischer (see Fette-Seifen-Anstrichmittel 65 (1963), pages 37 et seq).

The turbidity points of all the sugar derivatives determined according to DIN 53 917 were above 80° C.

Table I

| Sugar derivative number | Starting compound (mols) Sugar Mols | Polyglycol Mols | | Residual content of reducing sugar % | OH number | Biological degradation GF Test GF % |
|---|---|---|---|---|---|---|
| | | | | | | % |
| 1 | Glucose | (1) Tetraethylene glycol | (0.75) | 0.85 | 735 | —[x] |
| 2 | " | (1) Tetraethylene glycol | 0.6 | 0.52 | 759 | —[x] |
| 3 | " | (1) Polyethylene glycol 200 | (0.75) | 0.94 | 772 | —[x] |
| 4 | " | (1) Polyethylene glycol 300 | (0.75) | 0.65 | 615 | 81 |
| 5 | " | (1) Polyethylene glycol 300 | (1.0) | 0.41 | 588 | —[x] |
| 6 | " | (1) Polyethylene glycol 400 | (0.75) | 1.5 | 513 | 69–72 |
| 7 | " | (1) Polyethylene glycol 200 + 1PO | 0.75 | 3.4 | 651 | 69 |
| 8 | " | (1) Polyethylene glycol | (0.75) | 1.8 | 555 | 67 |
| 9 | " | (1) Glycerol + 6 EO | (0.75) | 1.03 | 625 | 51 |
| 10 | " | (1) Glycerol + 8 EO | (0.75) | 0.26 | 541 | —[x] |
| 11 | " | (1) Glycerol + 6 EO + 1 PO | (0.75) | 0.45 | 582 | —[x] |
| 12 | " | (1) Butylene glycol 1,4 + 3 EO | (0.750 | 0.75 | 721 | 68–72 |
| 13 | " | (1) Butylene glycol 1,4 + 4 EO | (0.75) | 0.66 | 663 | 68–69 |
| 14 | " | (1) Butylene glycol 1,4 + 6 EO | (0.75) | 0.98 | 553 | 73 |
| 15 | " | (1) Butylene glycol 1,3 + 4 EO | (0.75) | 0.62 | 643 | 74–75 |

Table I-continued

| Sugar derivative number | Starting compound (mols) Sugar Mols | Polyglycol Mols | | Residual content of reducing sugar % | OH number | Biological degradation GF Test GF % |
|---|---|---|---|---|---|---|
| 16 | Xylose | (1) Polyethylene glycol 200 | (0.75) | 0.74 | 631 | —[x] |
| 17 | Glucose-syrup DE 38 | (1) Polyethylene glycol 200 | (1,4) | 3.2 | 814 | —[x] |
| 18 | " | (1) Polyethylene glycol 400 | (1.4) | 1.7 | 724 | —[x] |
| 19 | Maltose | (1) Polyethylene glycol 200 | (1.4) | 1.25 | 736 | —[x] |

n EO = Number of mols of ethylene oxide
1 PO = One mole of propylene oxide
[x] = not determined

B. Foaming Characteristics

The foaming characteristics of various sugar derivatives according to the invention and of a sugar derivative prepared according to German DOS No. 2,110,994, example 1A, were determined by a foam stamping test (Hand stamping method according to DIN 53 902). The experimental results given in Table II demonstrate the highly advantageous foaming characteristics of the sugar derivatives according to the invention compared with the sugar derivatives described in the prior art.

The sugar derivatives indicated by the numbers given in Table I were added in an amount of 0.2 gm to tap water and stamped 20 times in a measuring cylinder at 20° C. and at 50° C. The height of the foam was then read off in centimeters after 10, 30 and 60 seconds. The tap water used had a hardness of 16° dH. (degrees German hardness).

TABLE II

| Dose: 0.2 gm of sugar derivative from Table I per liter of tap water; 20° C. | Height of foam in cm after 10 sec. | 30 sec. | 60 sec. |
|---|---|---|---|
| 7 | 8 | 0 | 0 |
| 9 | 0 | 0 | 0 |
| 10 | 7.5 | 1 | 0 |
| 11 | 8 | 0 | 0 |
| 3 | 0 | 0 | 0 |
| 4 | 0 | 0 | 0 |
| 6 | 2.5 | 0 | 0 |
| 17 | 0 | 0 | 0 |
| 12 | 0.5 | 0 | 0 |
| 13 | 1.1 | 0 | 0 |
| Sugar derivative according to Example 1A of German DOS No. 2,110,994 | No longer measurable due to excessive foaming | 8 | 1 |

When tested at 50° C., all the sugar derivatives of the invention were virtually free from foam.

C. Examples

Various clear-rinsing agent concentrates according to the invention with and without the addition of surface-active agents, with and without the addition of acid and with and without the addition of solvent are indicated in the following examples. They were used in dish washing machines with water of different degrees of hardness. Excellent clear-rinsing effects were obtained in all cases. No lime deposits were found on the dishes or in the machines and there were no signs of corrosion on the decorative overglaze. There was no troublesome foaming. All of the clear-rinse agents remained clear and stable in storage at temperatures of from −1° C. to 70° C.

EXAMPLE 1

Ordinary soiled dishes were washed in a dish washing machine at 55°–70° C., using an alkaline cleaning solution containing, per liter, 1.4 gm of sodium tripolyphosphate, 0.56 gm of sodium metasilicate and 0.04 gm of potassium dichloroisocyanurate, and the dishes were then rinsed in clear water.

The liquor used in the following clear rinsing operation contained from 0.5 to 0.9 gm per liter of an aqueous concentrate containing 20% by weight of the reaction product of 1 mol of glucose and 0.75 mol of a polyethylene glycol having an average molecular weight of 300 (number 4 from Table I). The temperature of the liquor was 60° to 70° C. The water used for the clear rinsing operation had been softened by a cation exchange resin so that it had a degree of hardness of 1° dH. After this treatment, a perfect clear drying effect was obtained at every concentration of the clear-rinse agent concentrate employed.

EXAMPLE 2

The experimental conditions employed were substantially the same as in Example 1 except that a commercial dish washing machine and tap water having a degree of hardness of 16° dH, was used. The liquor used for the clear rinsing operation contained 0.5 to 0.9 gm per liter of an aqueous concentrate which contained 30% by weight of the reaction product of glucose with a polyethylene glycol having an average molecular weight of 300 (number 5 in Table I),
0.3% by weight of sodium benzoate and
0.2% by weight of formaldehyde.

Here again, a clear drying effect with the best possible results on optical assessment was obtained at every concentration of the clear-rinsing agent concentrated employed.

EXAMPLE 3

Water with a degree of hardness of 16° dH which had been additionally hardened to 30° dH with calcium chloride was used in the following rinsing test. For each washing and rinsing operation, this water was introduced into the machine in the quantity required for a domestic dish washing machine. The dishes were washed with an alkaline cleaning solution containing 3.5 gm per liter of sodium tripolyphosphate, 1.4 gm per liter of sodium metasilicate and 0.1 gm per liter of potassium dichloroisocyanurate.

The liquor used for the clear-rinsing process contained 0.5 gm per liter of an aqueous concentrate which contained.

20% by weight of a reaction product of glucose and 0.75 mol of glycerol which had previously been reacted with 6 mol of ethylene oxide (number 9 in Table I) and 20% by weight of citric acid.

Satisfactory clear drying effects were obtained. Even after 150 washing and rinsing programs, no lime deposits and no signs of corrosion could be found either on the dishes or on the machine.

EXAMPLE 4

The following clear-rinse agent concentrate used under the experimental conditions of Example 3, consisted of 15% by weight of a reaction product of 1 mol of glucose and 0.75 mol of a polyethylene glycol having an average molecular weight of 300 (number 4 in Table I)

25% by weight of citric acid,

20% by weight of isopropanol,

5% by weight of a $C_{12-15}$ oxoalcohol reacted with 5.5 mols of ethylene oxide and 4.2 mols of propylene oxide, 0.4% by weight of sodium benzoate, 0.3% by weight of formaldehyde solution (30%), 0.7% by weight of perfume oil and 33.6% by weight of water.

This clear-rinse agent concentrate, used at concentrations of from 0.3–0.9 gm per liter of rinsing water, is equally suitable for use in dish washing machines with or without heating in the drying process.

EXAMPLE 5

Using the same conditions as in Example 4, equally good results were obtained with a clear-rinse agent consisting of a concentrate of the following composition.

10% by weight of a reaction product of 1 mol of glucose and 0.75 mol of the reaction product of 1 mol of glycerol with 6 mol of ethylene oxide (number 9 in Table I), 10% by weight of a $C_{12-15}$ oxoalcohol reacted with 5.5 mols of ethylene oxide and 4.2 mols of propylene oxide, 20% by weight of citric acid, 15% by weight of isopropanol, 17% by weight of dipropylene glycol, 0.3% by weight of sodium benzoate, 0.2% by weight of formaldehyde, 0.7% by weight of perfume oil and 26.8% by weight of water.

EXAMPLE 6

The experimental conditions employed were the same as in Example 1 but the liquor used in the clear-rinsing process contained, per liter, 0.3 gm of an aqueous concentrate containing 55% by weight of a reaction product of 1 mol of glucose with 0.75 mol of the reaction product of 1 mol of a glycerol with 6 mol of ethylene oxide (number 9 in Table I). Good clear drying effects were obtained and, after 150 washing and rinsing programs, no lime deposits were found either on the dishes or in the machine and no signs of corrosion were found on the overglaze on the china. No troublesome foaming occurred.

EXAMPLES 7 to 26

Clear-rinse agents concentrates according to the invention having the following composition were prepared using completely deionized water. The numbers given for the sugar derivatives are those used in Table I and the quantities of the constituents are indicated in percent by weight.

Table III

| Sugar derivative number | Sugar derivative % | Citric acid % | Isopropanol % | Sodium benzoate % | 35% Formaldehyde % | Completely deionized water % |
|---|---|---|---|---|---|---|
| 3 | 10 | — | 10 | 0.3 | 0.2 | 79.5 |
| 4 | 20 | — | 10 | — | — | 70 |
| 6 | 30 | — | — | 0.3 | 0.2 | 69.5 |
| 7 | 40 | — | — | 0.3 | 0.2 | 59.5 |
| 9 | 50 | — | — | 0.3 | 0.2 | 49.5 |
| 10 | 60 | — | — | 0.3 | 0.2 | 39.5 |
| 11 | 70 | — | — | 0.3 | 0.2 | 29.5 |
| 12 | 80 | — | — | 0.3 | 0.2 | 19.5 |
| 13 | 15 | — | 10 | — | — | 7.45 |
| 17 | 20 | — | 30 | 0.3 | 0.2 | 49.5 |
| 3 | 15 | 25 | — | 0.3 | 0.2 | 59.5 |
| 6 | 25 | 15 | — | 0.3 | 0.2 | 59.5 |
| 7 | 30 | 10 | — | 0.3 | 0.2 | 59.5 |
| 9 | 35 | 5 | 5 | 0.3 | 0.2 | 54.5 |
| 10 | 40 | 5 | 5 | 0.3 | 0.2 | 54.5 |
| 10 | 40 | 5 | 10 | 0.3 | 0.2 | 44.5 |
| 11 | 30 | 35 | 5 | 0.3 | 0.2 | 29.5 |
| 12 | 20 | 30 | 10 | 0.3 | 0.2 | 39.5 |
| 13 | 20 | 20 | 20 | 0.3 | 0.2 | 39.5 |
| 17 | 60 | 10 | — | 0.3 | 0.2 | 29.5 |

The clear-rinse agent concentrate in the above Table III contained from 10% to 80% by weight of the sugar derivative of the invention, 0 to 35% by weight of a hydroxyalkane carboxylic acid having 2 to 6 carbon atoms, 0 to 30% by weight of a water-miscible alcohol, 0 to 0.5% by weight of a preservative and 19.5% to 79.5% by weight of water.

The turbidity points of the clear-rinse agents concentrates given in Table III were above 84° C. The clear-rinse agents concentrates were clear and stable in storage at temperatures of from −1° C. to 70° C. All of the clear-rinse agents concentrates, in use, were virtually free from foam over the whole temperature range employed. Excellent clear drying effects were obtained with both the neutral and the acid clear-rinse agents concentrates.

EXAMPLE 27

To compare the clear drying effect of a neutral clear-rinse agent concentrate containing sheeting component (a) according to the invention (number 4 in Table I) with that of a sheeting component (b) described in Example 1A of German DOS No. 2,110,994 consisting of the adduct of 1 mol of saccharose and a total of 40 mols of propylene oxide, the following formulations were tested over a range of concentrations of 0.1 to 0.9 gm per liter of clear-rinse agents:

15.0% by weight of (a) or (b)

30.0% by weight isopropanol 0.3% by weigh sodium benzoate 0.2% by weight of formaldehyde (35%)

54.5% by weight of completely deionized water.

All of the empirical results determined optically over the whole range of concentrations on glasses, knives, plates and plastic dishes were distinctly superior in the case of the clear-rinse agents according to the invention compared with the clear-rinse agents containing (b), both with water at 1° dH and at 16° dH.

EXAMPLE 28

A comparison similar to that described in Example 27 was carried out on an acid clear-rinse agent concentrate having the following composition:

20.0% by weight of (a) or (b) as in Example 27
20.0% by weight citric acid
20.0% by weight isopropanol
0.3% by weight sodium benzoate
0.2% by weight 35% formaldehyde
39.5% by weight completely deionized water.

The results obtained from an optical-empirical assessment of the rinsed dishes was similar to that obtained in Example 27, in that the concentrate containing (a) was clearly superior both with softened water at 1° dH and tap water at 16° dH.

The preceding specific embodiments are illustrative of the practice of the invention. It is to be understood however, that other expedients known to those skilled in the art or disclosed herein, may be employed without departing from the spirit of the invention or the scope of the appended claims.

We claim:

1. A clear-rinse agent concentrate for mechanical dishwashers containing, as sheeting component, from 10% to 80% by weight of a reaction product obtained by reacting under acid catalysis conditions (1) an aldose selected from the group consisting of a reducing monosaccharide having 5 to 6 carbon atoms and an oligosaccharide thereof having from 2 to 4 monosaccharide units, with (2) a polyglycol ether having an average molecular weight of from 190 to 450, in a molar ratio of from 1:0.4 to 1:1.5, said reaction product having a residual quantity of free aldose of less than 4%.

2. The clear-rinse agent concentrate of claim 1 wherein said polyglycol ether has an average molecular weight of from 300 to 400.

3. The clear-rinse agent concentrate of claim 1 wherein said reaction product is obtained by reacting under acid catalysis condition said reducing monosaccharide and said polyglycol ether in a molar ratio of 1:0.75.

4. The clear-rinse agent concentrate of claim 1 wherein said reaction product is obtained by reacting under acidic catalysis conditions said oligosaccharide and said polyglycol ether in a molar ratio of 1:1.4.

5. The clear-rinse agent concentrate of claim 1 containing from 15% to 60% by weight of said sheeting component.

6. The clear-rinse agent concentrate of claim 1 wherein up to 50% by weight of said reaction product is replaced by a low-foaming, nonionic surface-active compound.

7. The clear-rinse agent concentrate of claim 1 wherein from 10% to 40% by weight of said reaction product is replaced by a low-foaming nonionic surface-active compound.

8. The clear-rinse agent concentrate of claim 1 having a further content of from 5% to 40% by weight of an hydroxyalkane carboxylic acid having from 2 to 6 carbon atoms.

9. The clear-rinse agent concentrate of claim 1 having a further content of from 10% to 35% by weight of an hydroxyalkane carboxylic acid having from 2 to 6 carbon atoms.

10. The clear-rinse agent concentrate of claim 1 having a further content of from 1% to 30% by weight of a water-miscible alcohol.

11. The clear-rinse agent concentrate of claim 1 having a further content of from 1% to 20% by weight of a water-miscible alcohol.

12. The clear-rinse agent concentrate of claim 1 having a further content of from 0.05% to 1% by weight of at least one preservative.

13. In the method of washing dishes in a mechanical dishwasher comprising the steps of subjecting the soiled dishes to the forceful spraying of a cleansing liquor containing a dishwashing detergent, rinsing said dishes with a forceful spray of clear water, subjecting the cleaned and rinsed dishes to the forceful spraying of a clear rinse liquor containing an effective amount of a sheeting component, and drying said cleaned dishes, the improvement consisting essentially of employing, as said sheeting component, from 0.05 to 2.6 gm per liter of said clear rinse liquor of a reaction product obtained by reacting under acid catalysis conditions (1) an aldose selected from the group consisting of a reducing monosaccharide having 5 to 6 carbon atoms and an oligosaccharide thereof having from 2 to 4 monosaccharide units, with (2) a polyglycol ether having an average molecular weight of from 190 to 450, in a molar ratio of from 1:0.4 to 1:1.5, said reaction product having a residual quantity of free aldose of less than 4%.

14. The process of claim 13 wherein said polyglycol ether has an average molecular weight of from 300 to 400.

15. The process of claim 13 wherein said reaction product is obtained by reacting under acid catalysis conditions said reducing monosaccharide and said polyglycol ether in a molar ratio of 1:0.75.

16. The process of claim 13 wherein said reaction product is obtained by reacting under acidic catalysis conditions said oligosaccharide and said polyglycol ether in a molar ratio of 1:1.4.

17. The clear-rinse agent concentrate of claim 1 wherein said polyglycol ether is selected from the group consisting of (1) polyoxyethylene glycols, (2) monopropoxylated ethers of polyoxyethylene glycols, (3) ethoxylated alkane diols having from 2 to 6 carbon atoms, (4) monopropoxylated ethers of (3), (5) ethoxylated alkoxyalkane diols having from 4 to 6 carbon atoms, (6) monopropoxylated ethers of (5), (7) ethoxylated alkane triols having 3 to 6 carbon atoms, and (8) monopropoxylated ethers of (7).

18. The process of claim 13 wherein said polyglycol ether is selected from the group consisting of (1) polyoxyethylene glycols, (2) monopropoxylated ethers of polyoxyethylene glycols, (3) ethoxylated alkane diols having from 2 to 6 carbon atoms, (4) monopropoxylated ethers of (3), (5) ethoxylated alkoxyalkane diols having from 4 to 6 carbon atoms, (6) monopropoxylated ethers of (5), (7) ethoxylated alkane triols having 3 to 6 carbon atoms, and (8) monopropoxylated ethers of (7).

19. A clear-rinse agent concentrate for mechanical dishwashers consisting essentially of (A) from 10% to 80% by weight of a sheeting component comsisting of 50% to 100% by weight of said sheeting component of a reaction product obtained by reacting under acid catalysis conditions (a) an aldose selected from the group consisting of a reducing monosaccharide having 5 to 6 carbon atoms and an oligosaccharide thereof having from 2 to 4 monosaccharide units, with (b) a polyglycol ether having an average molecular weight of from 190 to 450, selected from the group consisting of (1) polyoxyethylene glycols, (2) monopropoxylated ethers of polyoxyethylene glycols, (3) ethoxylated alkane diols having from 2 to 6 carbon atoms, (4) monopropoxylated ethers of (3), (5) ethoxylated alkoxyalkane diols having from 4 to 6 carbon atoms, (6) monopropoxylated ethers of (5), (7) ethoxylated alkane triols having 3 to 6 carbon atoms, and (8) monopropoxylated ethers of (7), in a molar ratio of a:b of from 1:0.4 to 1:1.5, said reaction product having a residual quantity of free aldose of less than 4%, and from 0 to 50% by weight of said sheeting component of a low-foaming, nonionic surface-active compound, (B) from 0 to 35% by weight of a hydroxyalkane carboxylic acid having from 2 to 6 carbon atoms, (C) from 0 to 30% by weight of a water-miscible alcohol, (D) from 0 to 0.5% by weight of at least one preservative and (E) from 19.5% to 79.5% by weight of water.

* * * * *